US006874341B1

(12) United States Patent
Shen

(10) Patent No.: US 6,874,341 B1
(45) Date of Patent: Apr. 5, 2005

(54) COMBINATION OF AN OUTSIDE SPINDLE AND A CORE RETAINER FOR A LOCK

(76) Inventor: Mu-Lin Shen, No. 18, Industry 3 Rd., An-Nan District, Tainan (TW)

( * ) Notice: Subject to any disclaimer, the term of this patent is extended or adjusted under 35 U.S.C. 154(b) by 0 days.

(21) Appl. No.: 10/729,617

(22) Filed: Dec. 5, 2003

(51) Int. Cl.[7] ..... E05B 9/04; E05B 13/10
(52) U.S. Cl. ..... 70/224; 70/371
(58) Field of Search ..... 70/221–224, 367–372, 70/DIG. 31, DIG. 39, 215–217, 451, 466

(56) References Cited

U.S. PATENT DOCUMENTS 3,212,306 A * 10/1965 Russell et al. ..... 70/224
3,286,773 A * 11/1966 Russell et al. ..... 70/371
3,718,015 A * 2/1973 Tornoe et al. ..... 70/224
4,319,470 A * 3/1982 White ..... 70/224
4,995,249 A * 2/1991 Preissler et al. ..... 70/224
5,398,531 A * 3/1995 Shen ..... 70/224
5,752,399 A * 5/1998 Shen ..... 70/224
6,014,877 A * 1/2000 Shen ..... 70/371
6,360,570 B1 * 3/2002 Shen ..... 70/224
6,532,779 B2 * 3/2003 Shen ..... 70/224

* cited by examiner

*Primary Examiner*—Lloyd A. Gall
(74) *Attorney, Agent, or Firm*—Alan D. Kamrath; Nikolai & Mersereau, P.A.

(57) ABSTRACT

An outside spindle is mounted to an outside handle of a lock to turn therewith. An outer end of the outside spindle includes a slot and at least one engaging piece formed thereon. A core retainer is securely mounted to the outer end of the outside spindle. The core retainer receives and positions a lock core interchangeably mounted in the outside handle. The core retainer includes a longitudinal slot aligned with the slot of the outside spindle, with the lock core extending into the slot of the outside spindle and the longitudinal slot of the core retainer. The core retainer further includes at least one positioning opening for securely receiving the engaging piece of the outside spindle, providing the lock core with a pulling-resisting effect in the axial direction.

9 Claims, 6 Drawing Sheets

COMBINATION OF AN OUTSIDE SPINDLE AND A CORE RETAINER FOR A LOCK

BACKGROUND OF THE INVENTION

1. Field of the Invention

The present invention relates to a combination of an outside spindle and a core retainer for a lock. In particular, the present invention relates to a combination of an outside spindle and a core retainer for positioning a lock core mounted in an outside handle of a lock.

2. Description of the Related Art

FIGS. 1 and 2 of the drawings illustrate a conventional lock comprising an inside assembly 1, an outside assembly 2, and a latch mechanism 3. The inside assembly 1 includes an inside handle 11, an inside rose 12, an inside rose liner 13 mounted inside the inside rose 12, and an inside spindle 16 extending through the inside rose 12 and the inside rose liner 13. The outside assembly 2 includes an outside handle 21, an outside rose 22, an outside rose liner 23 mounted inside the outside rose 22, and an outside spindle 26 extending through the outside rose 22 and the outside rose liner 23. A lock core 24 is mounted in the outside handle 21. A locking/unlocking bar 25 is mounted to an end of the outside spindle 26, and a core retainer 27 is mounted to the other end of the outside spindle 26.

The latch mechanism 3 is mounted between the inside rose liner 13 and the outside rose liner 23 and includes a casing 30, a latch 31, and a cam 32 that has a through-hole 321 through which the locking/unlocking bar 25 extends. When either handle 11, 21 is turned, the locking/unlocking bar 25 is turned to retract the latch 31 inward, achieving the unlatching operation.

The lock core 24 is mounted to the outer end of the outside spindle 26 and retained in place by the core retainer 27 in a manner allowing interchange of the lock core 24 when desired. The core retainer 27 includes a longitudinal slot 271 aligned with a slot 261 in the outer end of the outside spindle 26, with the lock core 24 being inserted into the slot 261 of the outside spindle 26. The core retainer 27 includes a protrusion 272 for engaging with a notch 262 in the outer end of the outside spindle 26, allowing joint rotation of the core retainer 27 and the outside spindle 26. The longitudinal slot 271 of the core retainer 27 includes an engaging section 273 against which a protrusion 241 of the lock core 24 abuts, thereby positioning the lock core 24.

The engaging force provided by the engagement between the protrusion 272 of the core retainer 27 and the notch 262 of the outside spindle 26 provides the lock core 24 with a torsion-resistant effect. However, if an axial pulling force is applied to the lock core 24, the lock core 24 might be damaged and pulled out.

To solve the above problem, U.S. Pat. No. 6,014,877 discloses a core retainer for a lock with an interchangeable lock core. The lock includes an upper slot and a lower slot, thereby defining two lateral walls each having an upper cut and a lower cut. The core retainer includes an insert received in the upper slot or the lower slot of the outside spindle. The insert includes two lugs received in the upper cuts or lower cuts of the outside spindle to prevent the lock core from being pulled outwardly in the axial direction. Nevertheless, the resultant structure of the lock is too complicated and results in increase in the cost.

SUMMARY OF THE INVENTION

An object of the present invention is to provide a combination of an outside spindle and a core retainer for improving pull-resisting effect of a lock core while reliably positioning the lock core mounted in an outside handle of a lock without resulting in a complicated lock structure.

In accordance with an aspect of the invention, the outside spindle is mounted to an outside handle of a lock to turn therewith. An outer end of the outside spindle includes a slot and at least one engaging piece formed thereon. In an embodiment of the invention, the outer end of the outside spindle includes two diametrically disposed engaging pieces. The core retainer is securely mounted to the outer end of the outside spindle. The core retainer receives and positions a lock core interchangeably mounted in the outside handle. The core retainer includes a longitudinal slot aligned with the slot of the outside spindle, with the lock core extending into the slot of the outside spindle and the longitudinal slot of the core retainer. The core retainer further includes at least one positioning opening spaced from two ends of the core retainer. In an embodiment of the invention, the core retainer includes two diametrically disposed positioning openings for securely receiving the engaging pieces of the outside spindle.

In an embodiment of the invention, each engaging piece is formed by pressing the outside spindle inward, leaving a substantially U-shaped opening, with the engaging piece extending inward into an interior of the outside spindle.

The lock core will not be damaged when an axial pulling force is applied. Accordingly, the pull-resisting property of the lock core of the lock is improved without resulting in a complicated lock structure while providing a torsion-resisting effect for the lock core.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
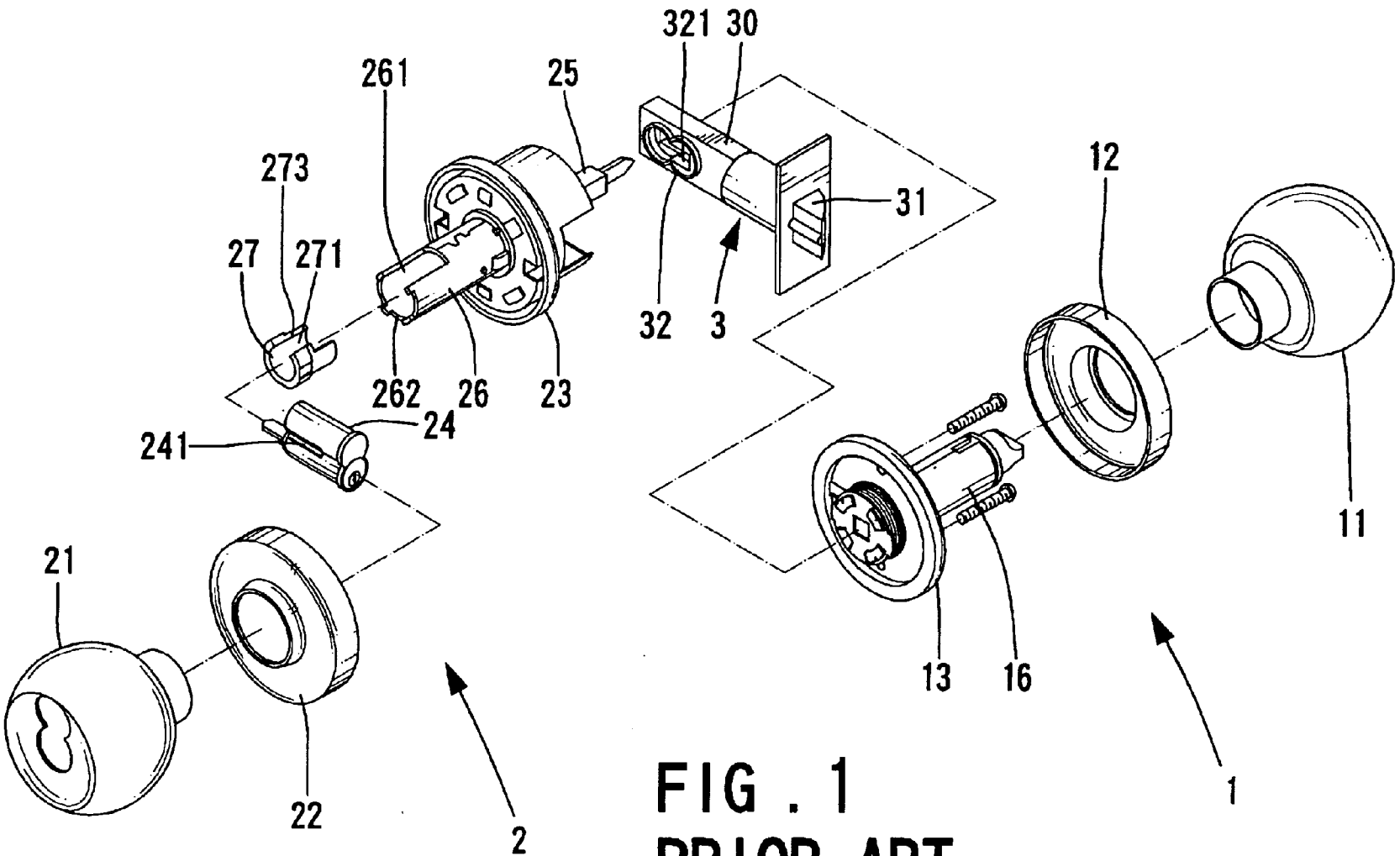
FIG. 1 PRIOR ART
FIG. 1 is an exploded perspective view of a conventional lock.
Figure 2:
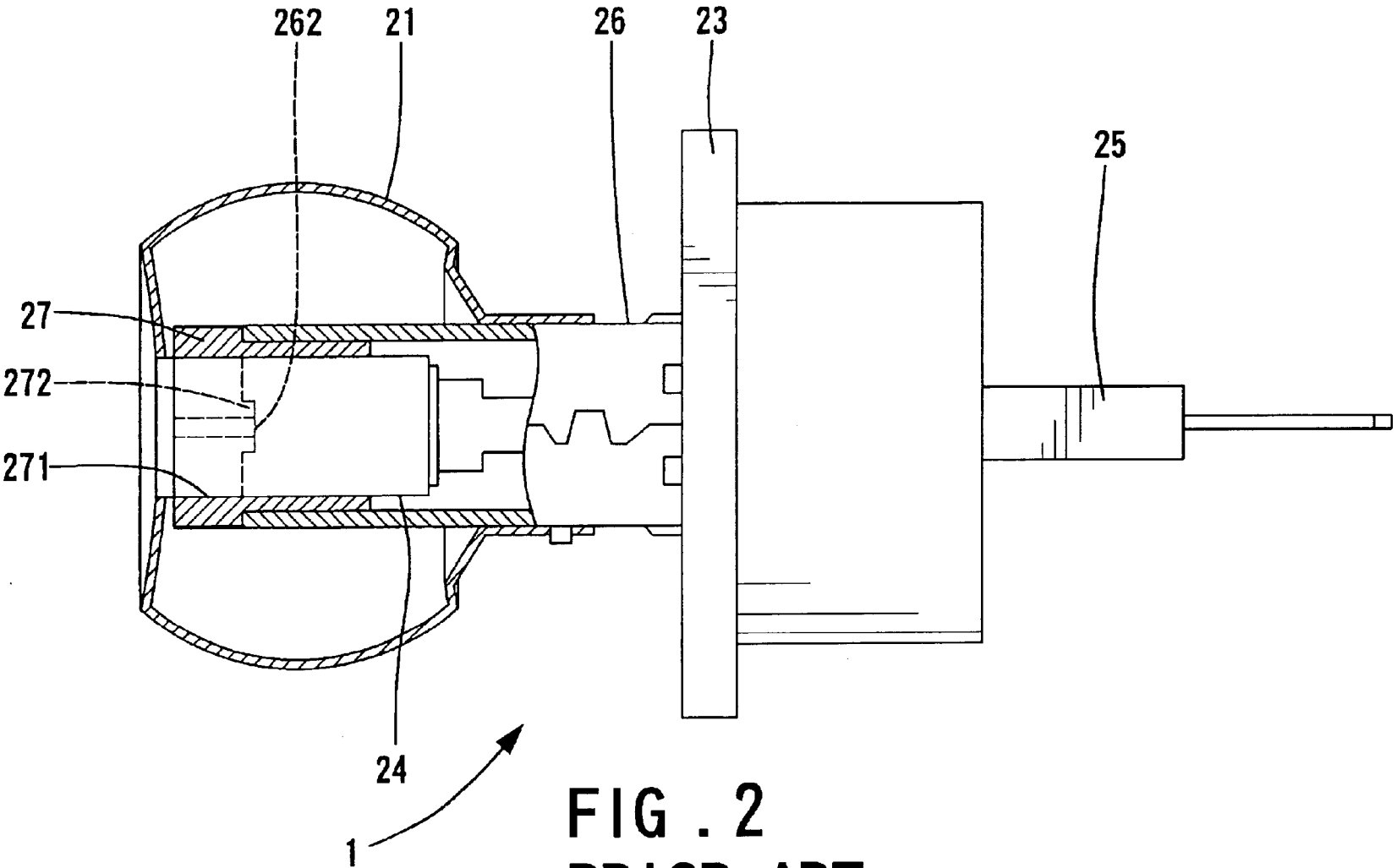
FIG. 2 PRIOR ART
FIG. 2 is a partly sectioned side view of a portion of the conventional lock.
Figure 3:
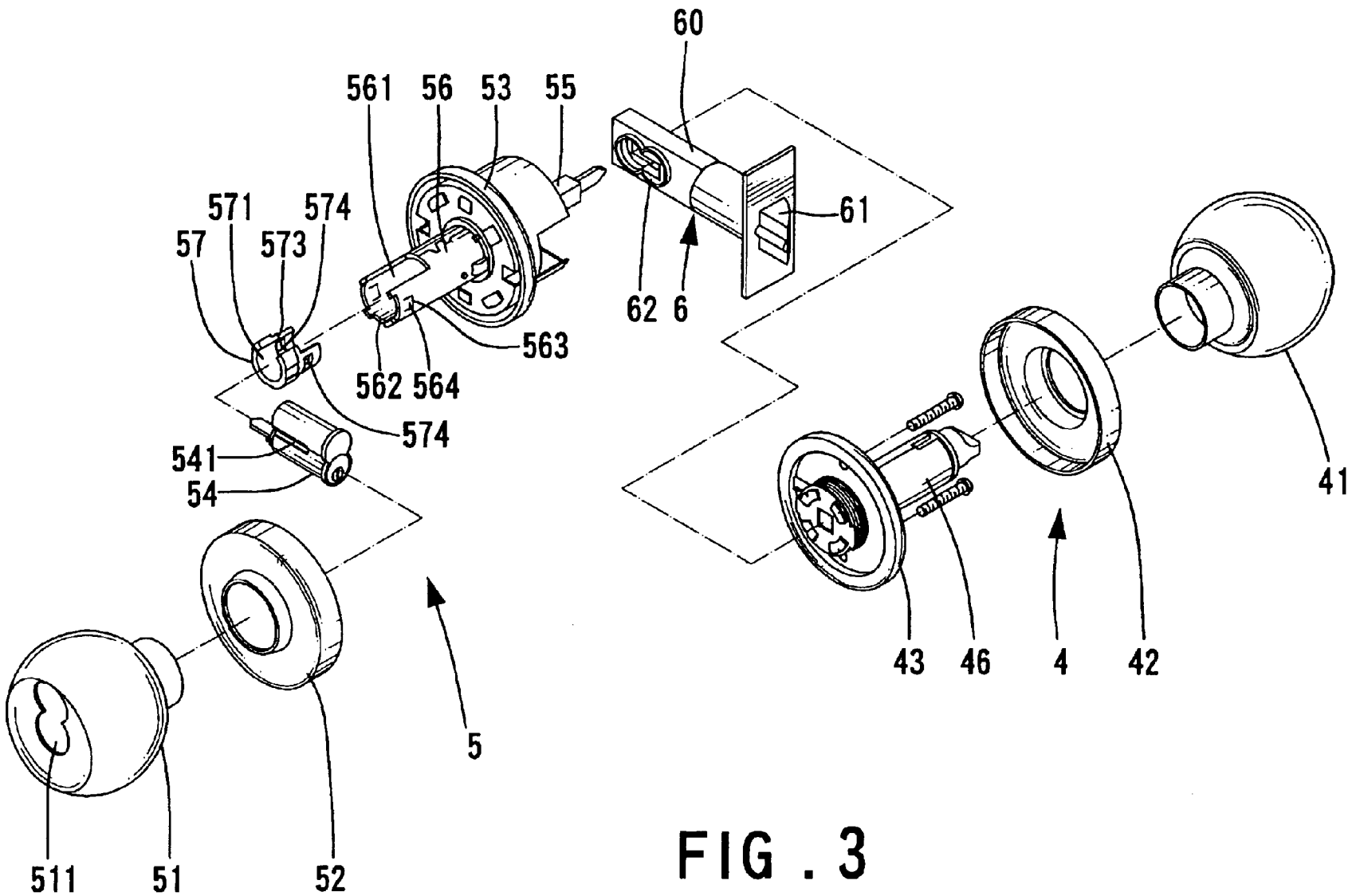
FIG. 3 is an exploded perspective view of a lock in accordance with the present invention.
Figure 4:
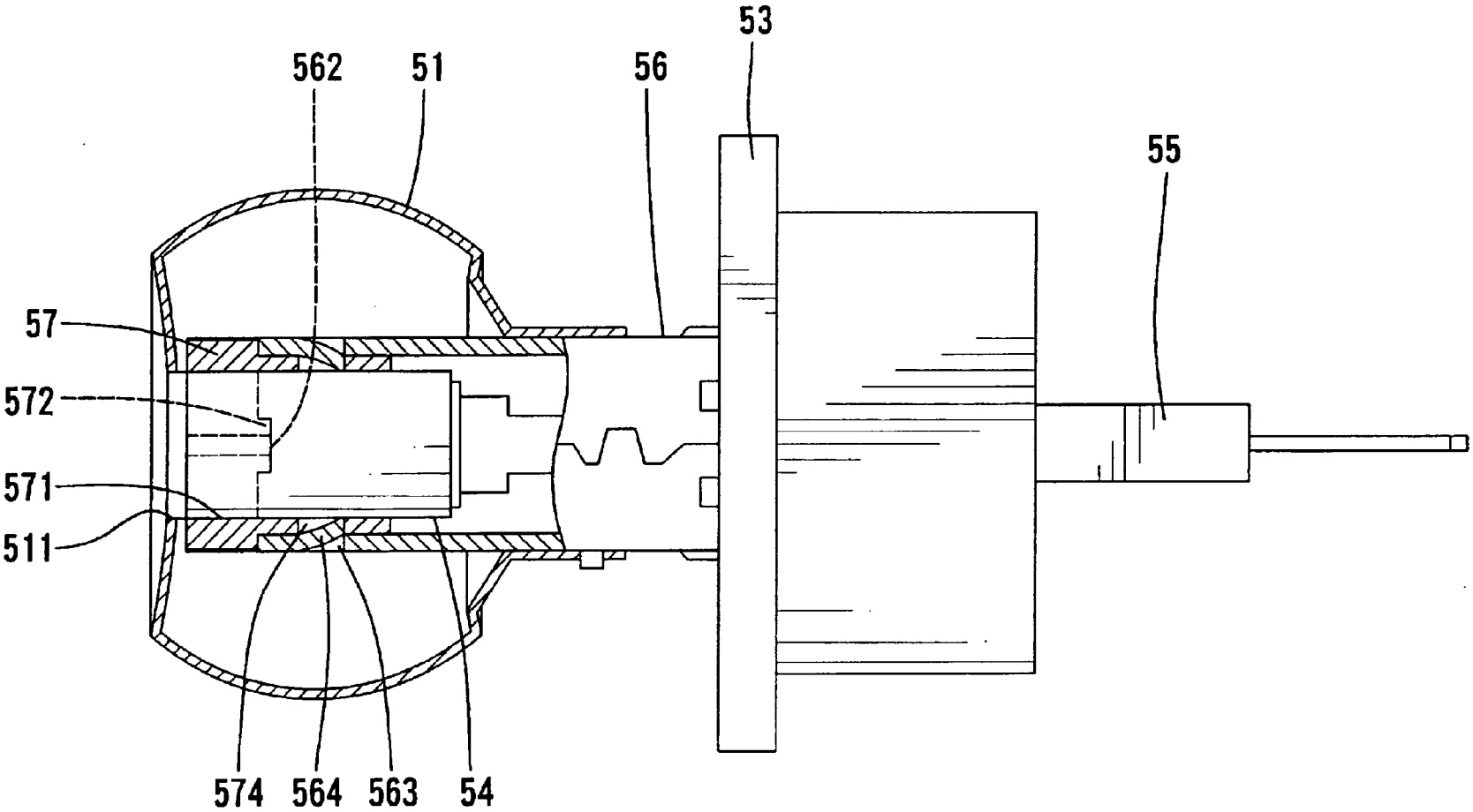
FIG. 4 is a partly sectioned side view of a portion of the lock in accordance with the present invention.

Referring to FIGS. 3 and 4, a lock in accordance with the present invention generally comprises an inside assembly 4, an outside assembly 5, and a latch mechanism 6. The inside assembly 4 includes an inside handle 41, an inside rose 42, an inside rose liner 43 mounted inside the inside rose 42, and an inside spindle 46 extending through the inside rose 42 and the inside rose liner 43. The outside assembly 5 includes an outside handle 51, an outside rose 52, an outside rose liner 53 mounted inside the outside rose 52, and an outside spindle 56 extending through the outside rose 52 and the outside rose liner 53. A locking/unlocking bar 55 is mounted to an inner end of the outside spindle 56, and a core retainer 57 is mounted to an outer end of the outside spindle 56.

The latch mechanism 6 is mounted between the inside rose liner 43 and the outside rose liner 53 and includes a casing 60, a latch 61, and a cam 62 that is operably connected to the latch 61 for retracting the latch 61 and that has a through-hole (not labeled) through which the locking/unlocking bar 55 extends. When either handle 41, 51 is turned, the locking/unlocking bar 55 is turned to retract the latch 61 inward, achieving the unlatching operation.

The outside handle 51 includes a figure "8" hole 511 for receiving an interchangeable lock core 54 having a corresponding cross section. The lock core 54 is inserted through the hole 511 of the outside handle 51 into the core retainer 57. The outer end of the outside spindle 56 includes a slot 561 and a notch 562. The core retainer 57 includes a longitudinal slot 571 aligned with the slot 561 of the outside spindle 56. The lock core 54 also extends into the slot 561 of the outside spindle 56. The core retainer 57 includes a protrusion 572 on an inner end thereof for engaging with the notch 562 of the outside spindle 56.

Figure 5:
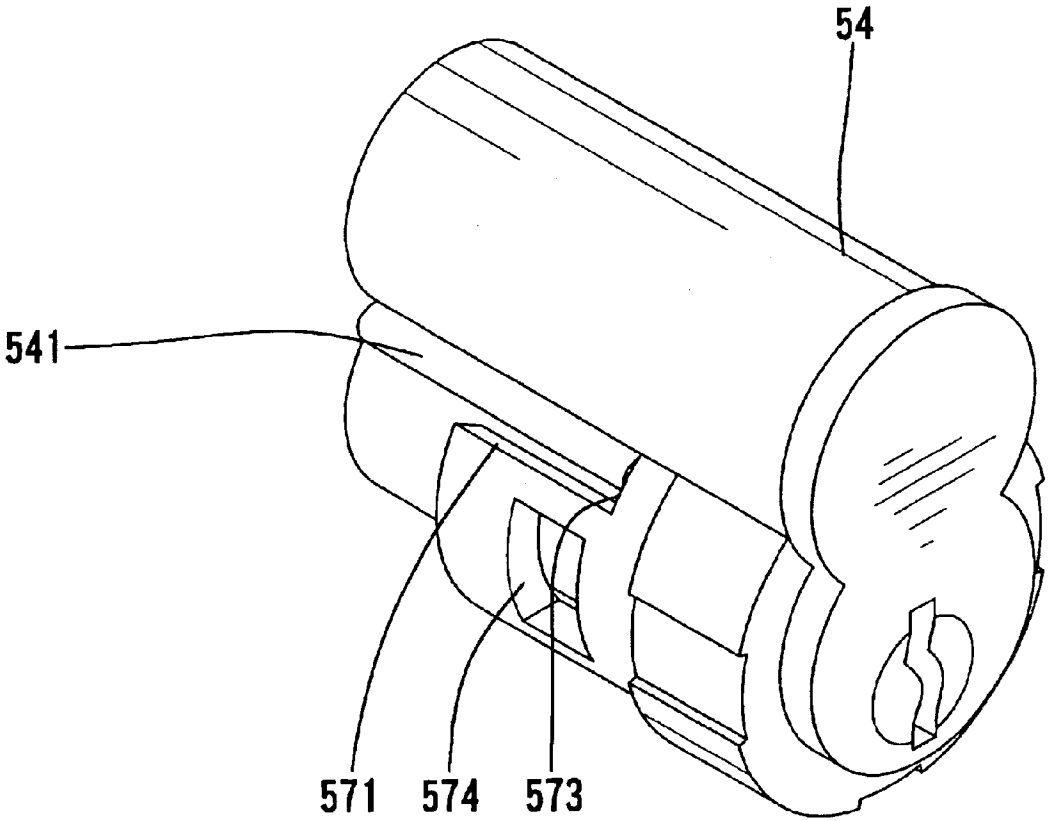
FIG. 5 is a perspective view illustrating engagement of a lock core and a core retainer of the lock in accordance with the present invention.
Figure 6:
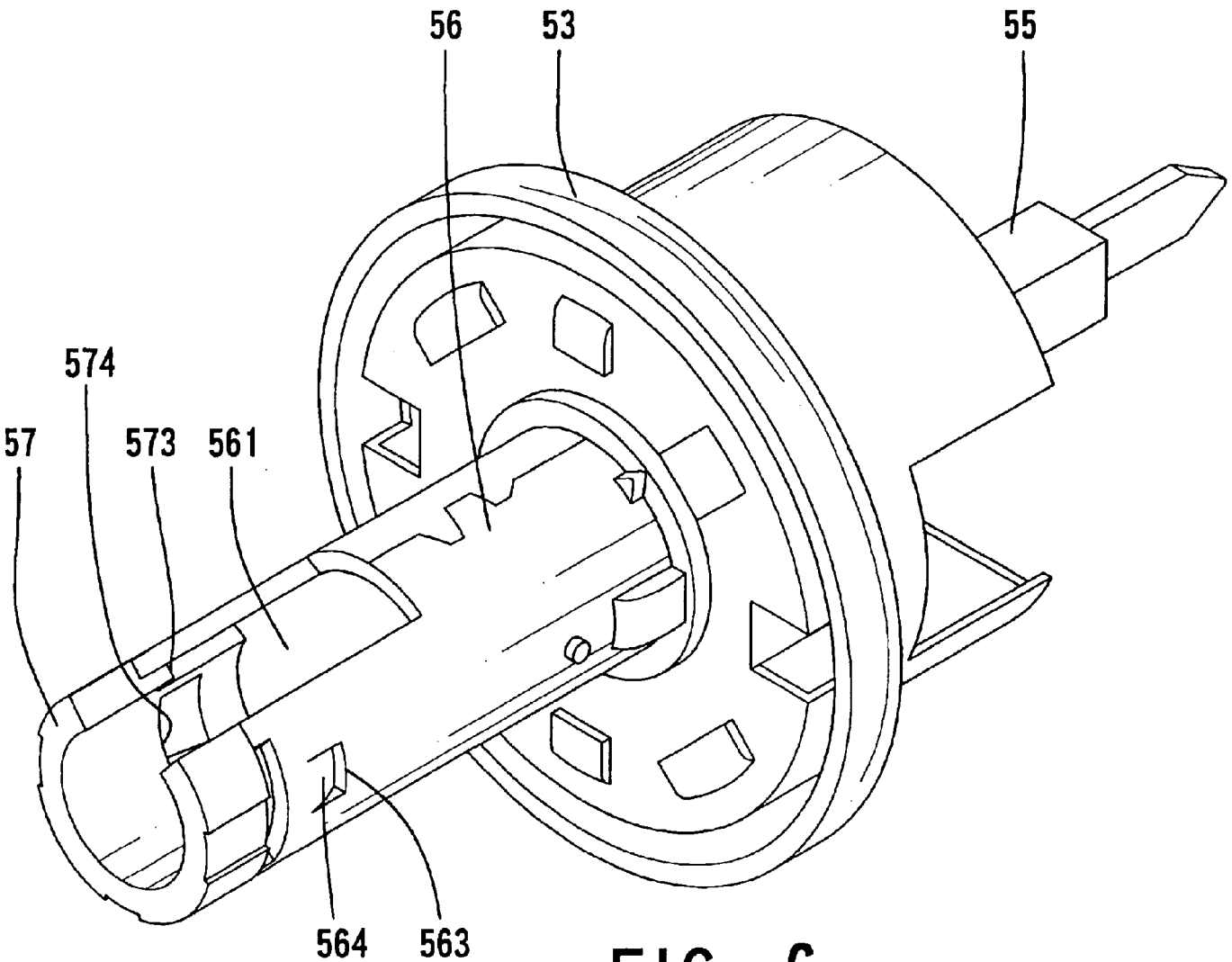
FIG. 6 is a perspective view showing engagement of the core retainer and the outside spindle of the lock in accordance with the present invention.

Still referring to FIGS. 3 and 4 and further to FIG. 5, the longitudinal slot 571 of the core retainer 57 includes an engaging section 573 into which a protrusion 541 of the lock core 54 extends and against which the protrusion 541 of the lock core 54 abuts, thereby positioning the lock core 54. The core retainer 57 further includes at least one positioning opening 574, and the outer end of the outside spindle 56 includes at least one engaging piece 564.

In this embodiment, the outer end of the outside spindle 56 includes two diametrically disposed engaging pieces 564, and the core retainer 57 includes two diametrically disposed positioning openings 574 spaced from two ends of the core retainer 57. The respective engaging piece 564 is formed by pressing the outside spindle 56 inward, leaving a substantially U-shaped opening 563 and an engaging piece 564 extending inward into an interior of the outside spindle 56. When the core retainer 57 is engaged with the outer end of the outside spindle 56, the respective engaging piece 564 of the outside spindle 56 is engaged with the respective positioning opening 574 of the core retainer 57, thereby providing a secure engagement between the core retainer 57 and the outside spindle 56. Thus, the core retainer 57 and the lock core 54 are provided with a pulling-resisting effect in the axial direction. Namely, the lock core 54 will not be damaged when an axial pulling force is applied. Accordingly, the pull-resisting property of the lock core 54 of the lock is improved without resulting in a complicated lock structure while providing a torsion-resisting effect for the lock core 54.

Although the invention has been explained in relation to its preferred embodiment, it is to be understood that many other possible modifications and variations can be made without departing from the scope of the invention as hereinafter claimed.

What is claimed is:

1. A combination of an outside spindle and a core retainer for a lock, the combination comprising:

an outside spindle including an outer end, the outside spindle being adapted to be mounted to an outside handle of a lock to turn therewith, the outer end of the outside spindle including a slot, the outer end of the outside spindle further including at least one engaging piece formed thereon; and a core retainer securely mounted to the outer end of the outside spindle, the core retainer being adapted to receive and position a lock core interchangeably mounted in the outside handle, the core retainer including a longitudinal slot aligned with the slot of the outside spindle, with the lock core extending into the slot of the outside spindle and the longitudinal slot of the core retainer, the core retainer including at least one positioning opening spaced from two longitudinally spaced ends of the core retainer, said at least one engaging piece of the outside spindle being securely received in said at least one positioning opening to secure the core retainer against both rotational movement and longitudinal movement relative to the outside spindle.

2. A combination of an outside spindle and a core retainer for a lock as claimed in claim 1, wherein said at least one engaging piece is formed by pressing the outside spindle inward, leaving a substantially U-shaped opening having legs parallel to the slot of the outside spindle, with said at least one engaging piece extending parallel to the slot and inward into an interior of the outside spindle and opposite to the outer end of the outside spindle.

3. A combination of an outside spindle and a core retainer for a lock as claimed in claim 1, wherein the outer end of the outside spindle includes a notch, and wherein the core retainer includes a protrusion engaged with the notch.

4. The combination of an outside spindle and a core retainer for a lock as claimed in claim 1, with the longitudinal slot of the core retainer including an engaging section, with the lock core including a protrusion abutting against the engaging section.

5. A combination of an outside spindle and a core retainer for a lock, the combination comprising:

an outside spindle including an outer end, the outside spindle being adapted to be mounted to an outside handle of a lock to turn therewith, the outer end of the outside spindle including a slot, the outer end of the outside spindle further including two diametrically disposed engaging pieces formed thereon; and a core retainer securely mounted to the outer end of the outside spindle, the core retainer being adapted to receive and position a lock core interchangeably mounted in the outside handle, the core retainer including a longitudinal slot aligned with the slot of the outside spindle, with the lock core extending into the slot of the outside spindle and the longitudinal slot of the core retainer, the core retainer including two diametrically disposed positioning openings for securely receiving the engaging pieces of the outside spindle, respectively;

wherein each said engaging piece is formed by pressing the outside spindle inward, leaving a substantially U-shaped opening, with said engaging piece extending inward into an interior of the outside spindle.

6. A combination of an outside spindle and a core retainer for a lock, the combination comprising:

an outside spindle including an outer end, the outside spindle being adapted to be mounted to an outside handle of a lock to turn therewith, the outer end of the outside spindle including a slot, the outer end of the outside spindle further including two diametrically disposed engaging pieces formed thereon; and a core retainer securely mounted to the outer end of the outside spindle, the core retainer being adapted to receive and position a lock core interchangeably mounted in the outside handle, the core retainer including a longitudinal slot aligned with the slot of the outside spindle, with the lock core extending into the slot of the outside spindle and the longitudinal slot of the core retainer, the core retainer including two diametrically disposed positioning openings for securely receiving the engaging pieces of the outside spindle, respectively;

wherein the outer end of the outside spindle includes a notch, and wherein the core retainer includes a protrusion engaged with the notch.

7. The combination of an outside spindle and a core retainer for a lock as claimed in claim 5, with the longitudinal slot of the core retainer including an engaging section, with the lock core including a protrusion abutting against the engaging section.

8. The combination of an outside spindle and a core retainer for a lock as claimed in claim 5, with the positioning openings being spaced from two ends of the core retainer.

9. The combination of an outside spindle and a core retainer for a lock as claimed in claim 6, with the positioning openings being spaced from two ends of the core retainer.

* * * * *